US009963757B2

(12) United States Patent
Woodcraft et al.

(10) Patent No.: US 9,963,757 B2
(45) Date of Patent: May 8, 2018

(54) PRECIPITATION HARDENING OF TANTALUM COATED METALS

(71) Applicant: Dow Global Technologies LLC, Midland, MI (US)

(72) Inventors: Valentina A. Woodcraft, Midland, MI (US); Eugene L. Liening, Freeland, MI (US)

(73) Assignee: Dow Global Technologies LLC, Midland, MI (US)

( * ) Notice: Subject to any disclaimer, the term of this patent is extended or adjusted under 35 U.S.C. 154(b) by 359 days.

(21) Appl. No.: 15/026,261

(22) PCT Filed: Nov. 19, 2014

(86) PCT No.: PCT/US2014/066258
§ 371 (c)(1),
(2) Date: Mar. 31, 2016

(87) PCT Pub. No.: WO2015/084586
PCT Pub. Date: Jun. 11, 2015

(65) Prior Publication Data

US 2016/0265074 A1 Sep. 15, 2016

Related U.S. Application Data

(60) Provisional application No. 61/910,563, filed on Dec. 2, 2013.

(51) Int. Cl.

| | |
|---|---|
| ***C21D 9/00*** | (2006.01) |
| ***C21D 1/74*** | (2006.01) |
| ***C21D 6/02*** | (2006.01) |
| ***C21D 6/04*** | (2006.01) |
| ***C21D 1/26*** | (2006.01) |
| ***C21D 1/613*** | (2006.01) |
| ***C22F 1/02*** | (2006.01) |
| ***C22F 1/18*** | (2006.01) |

(52) U.S. Cl.
CPC ..... *C21D 9/0068* (2013.01); *C21D 1/26* (2013.01); *C21D 1/613* (2013.01); *C21D 1/74* (2013.01); *C21D 6/02* (2013.01); *C21D 6/04* (2013.01); *C22F 1/02* (2013.01); *C22F 1/18* (2013.01)

(58) Field of Classification Search
CPC ..... C21D 1/18; C23C 8/02; Y10T 428/12812
USPC ..... 148/537
See application file for complete search history.

(56) References Cited

U.S. PATENT DOCUMENTS 3,342,590 A * 9/1967 Bieber ..... C22C 38/44 148/326
6,814,926 B2 * 11/2004 Geving ..... C22C 33/02 419/10

FOREIGN PATENT DOCUMENTS

| | | |
|---|---|---|
| CN | 1214374 | 4/1999 |
| CN | 101597728 | 12/2009 |
| CN | 101956198 | 1/2011 |
| CN | 102978579 | 3/2013 |
| CN | 102644077 | 12/2013 |
| GB | 2051873 | 12/1983 |

OTHER PUBLICATIONS

NPL-1: Gambale, Tantalum surface alloys prevent corrosion, Advanced Materials & Processes, Jun. 2010, pp. 23-25.*
K. R. Larsen: "Stainless steel with a tantalum surface alloy resists corrosion in an aggressive acid enviroment", Materials Performance, vol. 50, No. 4, Apr. 1, 2011 (Apr. 1, 2011), pp. 18-19, XP002735630, p. 19, paragraphs 1,2; figure 1.
"Handbook of nonferrous materials, vol. 2", Jul. 31, 2009, p. 194, 1st Edition, Edited by Boyun Huang, et al., Chemical Industry Press.
Advanced Materials & Processes, Jun. 30, 2010, Dean Gambale et. al, Tantalum Surface Alloys Prevent Corrosion, p. 23, Paragraphs 2-3.
English translation of Search report from corresponding Chinese 201480062907.9 application, dated Mar. 16, 2017.
Search report from corresponding Chinese 201480062907.9 application, dated Feb. 7, 2017.
Office Action from corresponding Chinese 201480062907.9 application, dated Dec. 12, 2017.
Xiancun Zhao, et al, High-strength and ultra-high-strength stainless steel, 1st Edition, Metallurgical Industry Press, May 31, 2008, pp. 619-620.

* cited by examiner

*Primary Examiner* — Jie Yang
(74) *Attorney, Agent, or Firm* — Steven W. Mork

(57) ABSTRACT

A process includes: (a) providing a tantalum-coated metal alloy substrate; (b) heat annealing the tantalum-coated metal alloy substrate by heating to an annealing temperature for the tantalum-coated metal alloy substrate, holding at the annealing temperature for a period of time and then quenching to a temperature below 50 degrees Celsius; (c) heating the tantalum-coated metal substrate to the precipitation hardening temperature of the metal alloy substrate; and (d) cooling the tantalum-coated metal alloy substrate to a temperature below 50 degrees Celsius; wherein the process is further characterized by carrying out steps (b)-(d) under a tantalum-inert gas atmosphere and by quenching in step (b) and cooling in step (d) being carried out by flowing a tantalum-inert gas having a temperature of less than 50 degrees Celsius over the tantalum-coated metal alloy substrate.

5 Claims, No Drawings

PRECIPITATION HARDENING OF TANTALUM COATED METALS

BACKGROUND OF THE INVENTION

Field of the Invention

The present invention relates to a process for precipitation hardening of a metal alloy that has been coated with tantalum.

Introduction

Metal alloys can be protected from corrosive attack by applying a coating of tantalum to the metal. Tantaline Inc. offers a service for vapor depositing tantalum onto metallic alloy substrates as a protective coating. The process requires heating a metallic alloy substrate in an oven to temperatures of 700-900 degrees Celsius (° C.) at which time tantalum metal precursor is vaporized and deposited onto the substrate. Unfortunately, heating the substrate metal alloy to such a high temperature can partially or completely anneal the substrate metal alloy thereby causing the substrate metal alloy to lose some of its desired physical properties such as hardness, tensile modulus and compressive modulus. Such is the case when the metal alloy substrate is a precipitation hardened (PH) metal alloy where that tantalum coating process results in loss of physical properties characteristic of being precipitation hardened.

It is desirable to discover how to obtain a tantalum coated PH metal alloy that benefits from both the durable tantalum coating and the precipitation hardened properties of the metal substrate.

BRIEF SUMMARY OF THE INVENTION

The present invention provides a process for producing a PH metal alloy substrate having protective properties of tantalum coating while also having the improved physical properties characteristic of being a PH metal alloy such as greater hardness, tensile modulus and compressive modulus.

Precipitation hardening, or regenerating precipitation hardening, of a tantalum coated metal alloy substrate without compromising the benefits of the tantalum coating is not a straightforward process, as was discovered while developing the present invention. Precipitation hardening requires heating a metal alloy to a particular temperature followed by rapid cooling of the material. Heating the tantalum-coated metal alloy in the presence of air at a temperature above 300° C. results in the tantalum coating becoming undesirably oxidized and brittle due to reaction with gasses in the air such as oxygen and nitrogen. Heating the tantalum-coated metal alloy in a tantalum-inert gas atmosphere to avoid making the tantalum coating brittle prevented sufficiently rapid cooling of the metal alloy core so as to preclude achieving precipitation hardening.

The present invention actually serves to solve not only the general problem of how to induce or restore PH properties to a tantalum-coated metal alloy substrate, but additionally how to accomplish such a solution without causing the tantalum coating to become brittle and/or spall off from the metal alloy substrate.

Surprisingly, the present invention is a result of discovering that a tantalum-coated metal alloy substrate can be precipitation hardened without causing the tantalum coating to become brittle by conducting the necessary heating steps under a tantalum-inert gas and cooling steps under a flow of relatively cool tantalum-inert gas. Suitable tantalum-inert gas includes noble gasses and combinations of noble gasses. Air is also a suitable tantalum-inert gas at temperatures below 300 degrees Celsius (° C.). The tantalum-inert gas does not react with the tantalum coating and does not diffuse appreciably into tantalum coating, thereby preventing the coating from becoming brittle. Flowing a cool tantalum-inert gas over the tantalum-coated metal alloy substrate allows for rapid cooling of the metal alloy substrate thereby allowing for precipitation hardening to occur.

In a first aspect, the present invention is a process comprising: (a) providing a tantalum-coated metal alloy substrate; (b) heat annealing the tantalum-coated metal alloy substrate by heating to an annealing temperature for the tantalum-coated metal alloy substrate, holding at the annealing temperature for a period of time and then quenching to a temperature below 50 degrees Celsius; (c) heating the tantalum-coated metal substrate to the precipitation hardening temperature of the metal alloy substrate; and (d) cooling the tantalum-coated metal alloy substrate to a temperature below 50 degrees Celsius; wherein the process is further characterized by carrying out steps (b)-(d) under a tantalum-inert gas atmosphere and by quenching in step (b) and step (d) being carried out by flowing a tantalum-inert gas having a temperature of less than 50 degrees Celsius over the tantalum-coated metal alloy substrate.

The present invention is useful for preparing tantalum-coated PH metal alloy substrates.

DETAILED DESCRIPTION OF THE INVENTION

The process of the present invention requires providing a tantalum-coated metal alloy substrate. Tantalum coating of metal substrates is a known technology and is commercially practiced by companies such as Tantaline, Inc., Ultramet COT and others. The metal alloy substrate that is tantalum-coated is a material that can undergo precipitation hardening. Prepare the tantalum-coated metal alloy substrate by providing a precipitation hardened metal alloy substrate and applying tantalum to the substrate while sustaining a temperature greater than 700 degrees Celsius (° C.). The resulting tantalum-coated metal alloy substrate has a homogeneous tantalum coating over the metal alloy substrate. Such a high temperature coating process is advantageous over lower temperature (below 700° C.) metal coating processes, such a sputter coating, because the lower temperature processes produce non-homogeneous metal coating over a substrate and do not result in a reinforcing intermetallic layer of tantalum with the metal alloy substrate. A homogeneous coating is desirable for optimal substrate protection by the tantalum coating.

Precipitation hardening, also known as heat-aging, is a technique for increasing the compressive strength of malleable metal alloys. Examples of suitable metal alloys that can undergo precipitation hardening include aluminum alloys, magnesium alloys, nickel alloys and stainless steels. The tantalum-coated metal alloy substrate is desirably selected from tantalum coated magnesium alloys, nickel alloys and stainless steels. The process of the present invention is particularly desirable for tantalum-coated stainless steel alloys. Specific examples of suitable stainless steel alloys include any one or any combination of more than one of the following grades of stainless steel: 17-PH, 17-7PH, 13-8PH, 15-5PH.

The process of the present invention requires heat annealing the tantalum-coated metal alloy substrate. Heat annealing required heating the tantalum-coated metal alloy substrate to a high enough temperature (annealing temperature) for a long enough period of time to allow dissolution of the precipitant phase in the metal alloy and then cooling (quenching) the tantalum-coated metal alloy substrate. Desirably, heat anneal by heating the tantalum-coated metal alloy substrate to a temperature above the critical temperature for the metal alloy of the tantalum-coated metal alloy substrate and holding for a period of time. The critical temperature for a metal alloy is typically readily available in metallurgy handbooks. Annealing can also be done by heating to sub-critical temperature, but that is a less desirable process for the present invention. For stainless steel alloys it is desirable to heat the tantalum-coated metal alloy substrate to a temperature in a range of 250 degrees or higher, preferably 650° C. or higher and yet more preferably 1000° C. or higher. At the same time, it is common to heat to a temperature of 1500° C. or lower.

Hold the tantalum-coated metal alloy substrate at the annealing temperature for a period of time long enough to allow the alloy solute phase to dissolve, preferably completely. Desirably, hold the tantalum-coated metal alloy substrate at the annealing temperature for 30 minutes or longer, preferably 45 minutes or longer, more desirably one hour or longer. While there is no known upper technical limit for how long to hold the material at the annealing temperature it is typical for practical purposes to hold it at annealing temperature for 48 hours or less, preferably 24 hours or less, still more preferably 12 hours or less.

Quench the tantalum-coated metal alloy substrate by quickly cooling to a temperature below 50° C., preferably to a temperature below 35° C. Rapid quenching in the annealing step is important to preserve very small, nanoparticle-like precipitate domains needed for successful precipitation hardening. However, if the tantalum-coated metal alloy substrate is cooled too quickly, the tantalum-coating and metal alloy substrate can change dimensions at sufficiently different rates so as to result in delamination of the tantalum-coating from the meal alloy substrate (spalling of the tantalum coating). Therefore, it is desirable to cool as rapidly as possible while avoiding delamination of the tantalum coating. Typically, it is desirable to cool the tantalum-coated metal alloy substrate at a rate in a range of 200° C. per hour to 300° C. per hour, preferably approximately 250° C. per hour.

The annealing step is important in order to properly prepare the metal alloy for precipitation hardening. Annealing dissolves the solute phase, preferably completely. Non-dissolved solute in the metal alloy can form domains that are large enough to hinder physical property enhancement during precipitation hardening.

After quenching in the heat annealing step, precipitation harden the tantalum-coated metal alloy substrate. Precipitation hardening includes heating to a precipitation hardening temperature, holding at or above the precipitation hardening temperature for a period of time and then cooling.

Heat the tantalum-coated metal alloy substrate to the precipitation hardening temperature of the metal alloy substrate. The precipitation hardening temperature of a metal alloy is the temperature at which the material will produce fine particles of impurity (solute) phase necessary for precipitation hardening to occur. Precipitation hardening temperatures for materials can be found in readily available resources such as in the procedure for ASTM A693-13 (Precipitation-Hardening Stainless and Heat-Resisting Steel Plate, Sheet, and Strip). As examples, the precipitation hardening temperature is 475° C. (890 degrees Fahrenheit (° F.)) or higher, typically 482° C. (900° F.) or higher, and often 496° C. (925° F.) or higher, 510° C. (950° F.) or higher, and can be 535° C. (995° F.), 565° C. (1050° F.) or higher. At the same time, the precipitation hardening temperature is generally 1100° C. (2012° F.) or lower, typically 1000° C. (1800° F.) or lower, and can be 925° C. (1700° F.) or lower, 900° C. (1173° F.) or lower, 800° C. (1073° F.) or lower, 700° C. (1292° F.) or lower, 600° C. (1112° C.) or lower and even 550° C. (1022° F.) or lower.

Precipitation hardening can include multiple steps of heating and cooling of the substrate as described in ASTM A693-13.

Hold the tantalum-coated alloy substrate at or above its precipitation hardening temperature for a period of time, typically for 30 minutes or more, preferably 45 minutes or more, more preferably an hour or more, still more preferably two hours or more, even more preferably three hours or more and possibly four hours or more. Generally, the tantalum-coated metal alloy substrate is held at the precipitation hardening temperature for less than 20 hours, preferably less than ten hours and can be less than five hours.

The precipitation hardening temperature and time at which the tantalum-coated metal alloy substrate is held at the precipitation hardening temperature determines the final properties of the metal alloy substrate. Therefore, variations in temperature and how long the metal alloy substrate is held at that temperature can be varied depending on the end properties desired.

Cool the tantalum-coated metal alloy substrate down to a temperature below 50° C. Desirably, cool the tantalum-coated metal substrate down to a temperature below 50° C. at an average cooling rate of 100° C. per hour or faster, preferably a rate of 125° C. per hour or faster and more preferably at a rate of 150° C. per hour or faster under a flow of tantalum-inert gas having a temperature of less than 50° C. It is important to cool no slower than 100° C. per hour in order to achieve a desirable increase in tensile strength properties (for example, ultimate tensile strength or modulus) of the metal alloy substrate. At the same time, to avoid spalling of the tantalum coating, it is desirable to cool at a rate of 300° C. or slower, preferably 250° C. or slower, more preferably 200° C. or slower. One desirable cooling rate is approximately 150° C. per hour.

Precipitation hardening can include multiple steps of heating and cooling as described in ASTM A693-13, but requires at least heating step to the precipitation hardening temperature and then cooling as described above.

It is important in the process of the present invention that the heat annealing and precipitation hardening (including heating to precipitation hardening temperature, holding at that temperature and then cooling) be done under a tantalum-inert gas atmosphere to preclude embrittlement and/or spalling of the tantalum coating. Desirably, the tantalum-inert gas atmosphere contains 99.99 mole-percent (mol %) or higher, preferably 99.995 mol % or higher, still more preferably 99.999 mol % or higher, yet more preferably 99.9995 mol % or higher and even more preferably 99.9999 mol % or higher of a tantalum-inert gas based on total moles of gas in the tantalum-inert gas atmosphere.

A tantalum-inert gas is a gas that does not react with tantalum, and preferably will not diffuse into tantalum, at temperatures in a range of 200-2000° C. For avoidance of doubt, the tantalum-inert gas is a gas in the temperature range of use. Examples of tantalum-inert gases include gases selected from the noble gases (helium, neon, argon, krypton, and xenon) including any combination of more than one noble gas. Air, and any component of air, is also a suitable tantalum-inert gas at temperatures up to 300° C.

The steps that are conducted under a tantalum-inert gas atmosphere cannot satisfactorily be conducted under a gas atmosphere that contains appreciable amounts of gas that is reactive with tantalum. If the annealing and precipitation hardening steps are conducted under a gas that is reactive with tantalum then the tantalum coating undergoes a chemical reaction and becomes undesirably brittle. For example, oxygen, nitrogen and hydrogen are all reactive with tantalum at temperatures above 300° C., causing it to become brittle. Carbon dioxide, ammonia and hydrocarbons are also known to react with tantalum at temperatures in the 300-2000° C. range. Desirably, the tantalum inert gas atmosphere contains less than 0.01 mole-percent (mol %), preferably 0.005 mol % or less, more preferably 0.001 mol % or less, still more preferably 0.0005 mol % or less, even more preferably 0.0001 mol % or less of any combination of oxygen, nitrogen and hydrogen (and more preferably any combination of oxygen, nitrogen, hydrogen, carbon dioxide, hydrocarbons and ammonia) based on total moles of gas molecules in the tantalum-inert gas atmosphere.

Moreover, the cooling (quenching) step after heating to the precipitation hardening temperature (and the quenching step during annealing) must be done by flowing a tantalum-inert gas having a temperature of less than 50° C. over the tantalum-coated metal substrate. It is important to flow the tantalum-inert gas over the tantalum-coated substrate during cooling in order to cool the tantalum-coated substrates at a sufficient rate. Flowing relatively cool (less than 50° C.) tantalum inert gas over the tantalum-coated substrate efficiently removes heat from the tantalum-coated substrate thereby cooling the substrate at a satisfactory rate. The relatively cool gas must be a tantalum-inert gas to preclude damage, such as embrittlement and/or spalling, of the tantalum coating.

EXAMPLES

Prepare samples using stainless steel tensile bars. The stainless steel is SS 17-4PH or 15-5PH condition 900 (H900) stainless steel as indicated below. The tensile bars are ASTM E8 Standard Subsize Tensile Bars with a rectangular cross section.

Evaluate the samples by measuring tensile properties and corrosion resistance. Characterize tensile properties according to ASTM E8-09. Determine corrosion resistance by submerging the sample in 20-35 wt % hydrochloric acid solution in water at 75° C. for 48 hours and evaluating samples for any signs of pitting.

Comparative Example A

For Comparative Example A, evaluate a 17-4PH stainless steel tensile bar without any further treatment (that is, without a tantalum coating or any thermal conditioning). Comparative Example A has an ultimate tensile strength (UTS) of 1448 MegaPascals (MPa). Comparative Example A nearly dissolve in the corrosion test and could not be recovered.

Comparative Example B

Comparative Example B is the same as Comparative Example A except the tensile bar is coated with a tantalum coating by Tantaline Inc. according to their commercial coating technology. Characterize Comparative Example B after coating with tantalum. Comparative Example B has an average UTS of 1065 MPa (average of two measurements: 1027 MPa and 1103 MPa). No signs of pitting were observed in the corrosion test.

Example 1

Example 1 is the same as Comparative Example B except further subjected to an annealing and precipitation hardening thermal reconditioning profile after coating with tantalum and prior to characterizing corrosion resistance and tensile properties. Use a thermal reconditioning profile as shown in Table 1 where precipitation hardening is done directly after annealing. Subject the sample to the thermal reconditioning profile in an argon atmosphere by flowing argon (at least 99.999 mole-percent argon) over the sample. The argon is at ambient temperature (approximately 23° C.).

TABLE 1

| Elapsed Time (minutes) | Temperature (° C.) | Rate of Temperature Change (° C./hour) |
|---|---|---|
| | Annealing | |
| 0 | 32 | Not Applicable (start temp) |
| 69 | 1038 | 875 |
| 129 | 1038 | 0 |
| 369 | 32 | −252 |
| | Precipitation Hardening | |
| 399 | 32 | 0 |
| 468 | 485 | 394 |
| 528 | 485 | 0 |
| 708 | 32 | −151 |

Example 1 has an average UTS of 1280 MPa (average of three measurements: 1289 MPa, 1282 MPa and 1269 MPa). No pitting was observed in the corrosion test.

The tensile properties and corrosion properties of Comparative Examples A and B and Example 1 illustrate that the process of the present invention provides a metal alloy substrate that benefits from the corrosion resistance of a tantalum coating and greater tensile strength not normally present in a tantalum coated sample. A comparison of the tensile strength of Comparative Examples A and B reveals how the tantalum coating process reduces the tensile strength of the metal alloy substrate. Example 1 illustrates that the process of the present invention restores at least a portion of the tensile strength of the metal alloy substrate while retaining the corrosion resistance of the tantalum coating.

Example 2

Prepare Example 2 in a similar manner as Example 1, except use a 15-5PH stainless steel tensile bar coated with a tantalum coating by Tantaline Inc. Further subject the tantalum coated bar to an annealing and precipitation hardening thermal reconditioning profile after being tantalum coated and prior to characterizing corrosion resistance and tensile properties. Use a thermal reconditioning profile as shown in Table 1 where precipitation hardening is done directly after annealing. Subject the resulting sample to thermal reconditioning profile in an argon atmosphere by flowing argon (99.999 mole-percent argon) at a temperature of approximately 23° C. over the sample. Example 2 has an average UTS of 1344 MPa. No pitting was observed in the corrosion test.

Example 2 further illustrates the benefit of the process of the preset invention using a stainless steel substrate different from Example 1.

When the annealing and precipitation hardening of the tantalum-coated metal alloy substrate of Example 1 and Example 2 were done in an air atmosphere, the tantalum coating oxidized and failed thereby reducing the corrosion resistance of the resulting samples. Similar results are expected if the annealing and precipitation hardening are done in any other non-tantalum-inert gas atmosphere.

The invention claimed is:

1. A process comprising:

(a) providing a tantalum-coated metal alloy substrate prepared by providing a precipitation hardened metal alloy substrate and applying tantalum to the substrate while sustaining a temperature greater than 700 degrees Celsius, characterized by resulting in a homogeneous tantalum coating over the metal alloy substrate;

(b) heat annealing the tantalum-coated metal alloy substrate by heating to an annealing temperature for the tantalum-coated metal alloy substrate, holding at the annealing temperature for a period of time and then quenching to a temperature below 50 degrees Celsius;

(c) heating the tantalum-coated metal substrate to the precipitation hardening temperature of the metal alloy substrate; and (d) cooling the tantalum-coated metal alloy substrate to a temperature below 50 degrees Celsius;

wherein the process is further characterized by carrying out steps (b)-(d) under a tantalum-inert gas atmosphere and by quenching in step (b) and cooling in step (d) being carried out by flowing a tantalum-inert gas having a temperature of less than 50 degrees Celsius over the tantalum-coated metal alloy substrate.

2. The process of claim 1, further characterized by the tantalum-inert gas comprising a noble gas.

3. The process of claim 1, further characterize by the tantalum-inert gas comprising at least 99.999 mole-percent argon based on total tantalum-inert gas composition.

4. The process of claim 1, further characterized by the metal alloy substrate that is tantalum-coated being a stainless steel.

5. The process of claim 1, further characterized by step (d) causing the tantalum-coated metal alloy substrate to cool from the precipitation hardening temperature to a temperature below 50 degrees Celsius at a rate of 100 degrees Celsius per hour or faster and 200° C. per hour or slower.

* * * * *